US008991961B2

(12) United States Patent
Kyoutani

(10) Patent No.: US 8,991,961 B2
(45) Date of Patent: Mar. 31, 2015

(54) LIQUID DISCHARGE APPARATUS, METHOD AND STORAGE MEDIUM FOR COMPUTER-READABLY STORING PROGRAM THEREIN

(75) Inventor: Tadao Kyoutani, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 402 days.

(21) Appl. No.: 13/430,043

(22) Filed: Mar. 26, 2012

(65) Prior Publication Data

US 2012/0249645 A1 Oct. 4, 2012

(30) Foreign Application Priority Data

Mar. 31, 2011 (JP) ..... 2011-080773

(51) Int. Cl.

| | |
|---|---|
| ***B41J 29/38*** | (2006.01) |
| ***B41J 2/045*** | (2006.01) |
| ***B41J 2/155*** | (2006.01) |
| ***B41J 2/21*** | (2006.01) |
| ***B41J 13/00*** | (2006.01) |

(52) U.S. Cl.

CPC ..... *B41J 29/38* (2013.01); *B41J 2/0454* (2013.01); *B41J 2/155* (2013.01); *B41J 2/2135* (2013.01); *B41J 2/2146* (2013.01); *B41J 13/0027* (2013.01)

USPC ..... 347/14; 347/9; 347/10; 347/19

(58) Field of Classification Search

CPC ..... B41J 2/0454

USPC ..... 347/19, 14, 9, 10

See application file for complete search history.

(56) References Cited

U.S. PATENT DOCUMENTS 5,485,182 A * 1/1996 Takayanagi et al. ..... 347/17
2005/0206921 A1 9/2005 Aruga et al.

FOREIGN PATENT DOCUMENTS

| | | | |
|---|---|---|---|
| JP | 2001-113678 A | | 4/2001 |
| JP | 2002-113851 | * | 4/2002 |
| JP | 2005-262668 | | 9/2005 |
| JP | 2009-6550 A | | 1/2009 |

OTHER PUBLICATIONS

English Machine translation of JP2002-113851, retrieved May 7, 2013.*

Japanese Office Action dated Apr. 16, 2013 from corresponding Japanese Patent Application No. 2011-080773, together with an English language translation.

* cited by examiner

*Primary Examiner* — Manish S Shah
*Assistant Examiner* — Jeffrey C Morgan
(74) *Attorney, Agent, or Firm* — Scully, Scott, Murphy & Presser PC

(57) ABSTRACT

An inkjet printer includes a liquid discharge head, a temperature sensor, and a controller. The controller changes a voltage waveform to be input to the ink discharge head, while a nozzle surface is facing a first gap. The temperature sensor measures a first actual temperature of the ink discharge head, while the nozzle surface is facing a second gap. The controller calculates, on the basis of the first actual temperature and a discharge history of ink discharged to a sheet located between the first gap and the second gap, a first estimated temperature of the ink discharge head corresponding to the time in which the nozzle surface is facing the first gap. The controller changes the voltage waveform on the basis of the first estimated temperature.

11 Claims, 7 Drawing Sheets

LIQUID DISCHARGE APPARATUS, METHOD AND STORAGE MEDIUM FOR COMPUTER-READABLY STORING PROGRAM THEREIN

CROSS REFERENCE TO RELATED APPLICATION

This application claims priority from Japanese Patent Application No. 2011-080773, filed on Mar. 31, 2011, the entire subject matter of which is incorporated herein by reference.

TECHNICAL FIELD

The present invention relates to a liquid discharge apparatus including a liquid discharge head which receives an input of a voltage waveform for discharging liquid from nozzles, a method for the discharging a liquid and a storage medium for computer-readably storing program for the liquid discharge apparatus.

BACKGROUND

In a printing device including a liquid discharge head driven by a voltage waveform input thereto, a change in head temperature due to, for example, the drive history of the liquid discharge head causes a change in the amount of discharged liquid and fluctuation of the print density, even if the same voltage waveform is input. It is therefore desirable that the voltage value of the voltage waveform to be input (i.e., drive voltage) is appropriately adjusted in accordance with the change of the head temperature. If the drive voltage is adjusted during printing on a recording medium, however, the print density changes during the printing, and thus the image quality is deteriorated. In view of this, an image forming apparatus has been known which constantly detects the temperature of a recording head, and changes the drive voltage of the recording head on the basis of the detected head temperature while a recording area of the recording head is facing a medium gap between recording media.

In the above-described image forming apparatus, the temperature of the recording head is constantly detected, and the drive voltage to be input to the head is adjusted on the basis of the latest one of the detected head temperatures during a short time in which the recording area of the recording head is facing the medium gap between recording media.

SUMMARY OF THE INVENTION

However, image forming may occur during high speed imaging. In this case, if the image forming speed is fast, the time for detecting temperature is further shortened. Consequently, one problem during high speed imaging is that the adjustment of the drive voltage of the head may fail to be completed within the time. If the drive voltage is not adjusted, the print density changes from the print density corresponding to a recording demand (print data command), and thus the image quality is deteriorated.

The present invention has been made to address the above-described issue, and an object thereof is to provide to a liquid discharge apparatus and a storage medium for computer-readably storing program therefor capable of appropriately adjusting the voltage waveform to be input to the liquid discharge head, even if the printing speed is increased.

To address the above-described issue, a liquid discharge apparatus according to an aspect of the present invention includes a liquid discharge head having a nozzle surface including nozzles for discharging liquid, the liquid discharge head being configured to receive a voltage signal having a waveform for discharging the liquid from the nozzles, a recording medium conveying unit being configured to successively convey a plurality of recording media in a conveying direction, the plurality of recording media being conveyed with a plurality of gaps between each recording medium, a temperature sensor configured to output temperature information of an actual temperature of the liquid discharge head while the nozzle surface is facing a second gap of the plurality of gaps located downstream of a first gap of the plurality of gaps in the conveying direction, a controller. The controller configured to determine, based on the temperature information of the actual temperature received from the temperature sensor and a discharge history relating to the liquid discharged from the liquid discharge head to the recording medium between the first gap and the second gap, an estimated temperature of the liquid discharge head before the nozzle surface faces the first gap and determine the waveform based on the estimated temperature, while the nozzle surface is facing the first gap.

A storage device for computer-readably storing a computer-executable program executable by a processor of a liquid discharge apparatus including a liquid discharge head having a nozzle surface including nozzles for discharging liquid, the liquid discharge head being configured to receive a signal having a waveform for discharging the liquid from the nozzles, recording medium conveying unit being configured to successively convey a plurality of recording media in a conveying direction, the plurality of recording media being conveyed with a plurality of gaps between each recording medium, a temperature sensor configured to output temperature information of a actual temperature of the liquid discharge head while the nozzle surface is facing a second gap of the plurality of gaps located downstream of a first gap of the plurality of gaps in the conveying direction. The program causing the processor to execute functions comprising determining, based on the temperature information of the actual temperature received from the temperature sensor and a discharge history relating to the liquid discharged from the liquid discharge head to the recording medium between the first gap and the second gap, a estimated temperature of the liquid discharge head before the nozzle surface faces the first gap and determining the waveform based on the estimated temperature, while the nozzle surface is facing the first gap.

A method for discharging a liquid from a liquid discharge apparatus including a liquid discharge head having a nozzle surface including nozzles for discharging liquid, the liquid discharge head being configured to receive a signal having a waveform for discharging the liquid from the nozzles, recording medium conveying unit being configured to successively convey a plurality of recording media in a conveying direction, the plurality of recording media being conveyed with a plurality of gaps between each recording medium, a temperature sensor configured to output temperature information of a actual temperature of the liquid discharge head while the nozzle surface is facing a second gap of the plurality of gaps located downstream of a first gap of the plurality of gaps in the conveying direction. The method comprising the steps of determining, based on the temperature information of the actual temperature received from the temperature sensor and a discharge history relating to the liquid discharged from the liquid discharge head to the recording medium between the first gap and the second gap, a estimated temperature of the liquid discharge head before the nozzle surface faces the first gap and determining the waveform based on the estimated temperature, while the nozzle surface is facing the first gap.

DESCRIPTION OF THE PREFERRED EMBODIMENTS

Preferred embodiments of a liquid discharge apparatus according to an embodiment of the present invention will be described below with reference to the drawings. In the following embodiments, a "liquid discharge apparatus" according to an embodiment of the present invention is applied to an inkjet printer, and ink and an ink discharge head are used as "liquid" and a "liquid discharge head," respectively. Further, a sheet and a sheet conveying mechanism are used as a "recording medium" and "recording medium conveying unit," respectively.

First Embodiment

Figure 1:
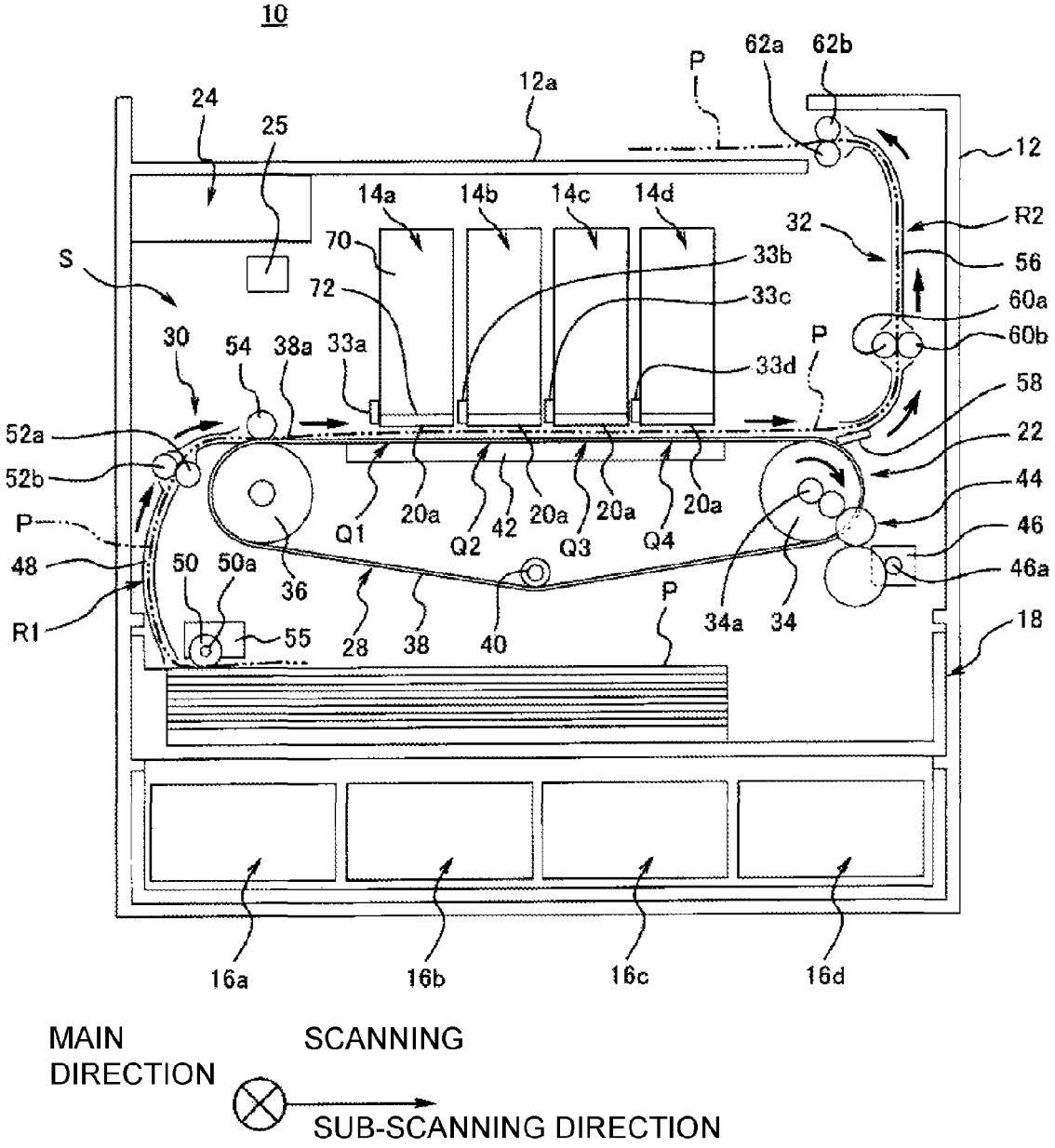
FIG. 1 is a conceptual diagram illustrating a configuration of an inkjet printer (liquid discharge apparatus) according to a first embodiment.

As illustrated in FIG. 1, the inkjet printer 10 includes a substantially rectangular parallelepiped-like housing 12, four ink discharge heads 14*a* to 14*d* which discharge inks of four colors (magenta, cyan, yellow, and black), respectively, and four ink tanks 16*a* to 16*d* which separately contain the inks of four colors, respectively. The inkjet printer 10 further includes a sheet cassette 18 which stores sheets P, a sheet conveying mechanism 22 which conveys the sheets P, and a controlling unit 24 (controller) which executes a variety of controlling operations.

As illustrated in FIG. 1, the interior of the housing 12 has a space S which stores a variety of devices, and an upper surface of the housing 12 is provided with a sheet discharge unit 12*a* which receives the sheets P discharged outside the housing 12. Further, the ink tanks 16*a* to 16*d* are attachably and detachably disposed in a bottom portion of the space S, and the sheet cassette 18 is attachably and detachably disposed above the ink tanks 16*a* to 16*d* in the bottom portion of the space S. Further, the ink discharge heads 14*a* to 14*d* and the controlling unit 24 are disposed in an upper portion of the space S, and the sheet conveying mechanism 22 is disposed in a vertically central portion and an upper portion of the space S. Further, an ambient temperature sensor 25 which measures an ambient temperature $T_Z$ is disposed near the ink discharge heads 14*a* to 14*d* in the upper portion of the space S.

Each of the ink discharge heads 14*a* to 14*d* has a nozzle surface 20*a* provided with a plurality of nozzles 20 (FIG. 3) which discharge the ink. Areas facing the plurality of nozzles 20 (FIG. 3) of the respective ink discharge heads 14*a* to 14*d*, i.e., areas facing the respective nozzle surfaces 20*a* form discharge areas Q1 to Q4 in which the respective inks are discharged to the sheets P. In the present embodiment, the four discharge areas Q1 to Q4 are disposed in juxtaposition in the horizontal direction, and the sheet conveying mechanism 22 is configured to successively convey a plurality of sheets P in a conveying direction to pass the sheets P through the discharge areas Q1 to Q4.

Configuration of Sheet Conveying Mechanism: As illustrated in FIG. 1, the sheet conveying mechanism 22 includes a conveying unit 28, a sheet feeding unit 30, a sheet discharging unit 32, and sheet sensors 33*a* to 33*d*. The conveying unit 28 conveys the sheets P to pass the sheets P through the discharge areas Q1 to Q4. The sheet feeding unit 30 is provided upstream of the conveying unit 28 in the conveying direction, and supplies the conveying unit 28 with the sheets P stored in the sheet cassette 18. The sheet discharging unit 32 is provided downstream of the conveying unit 28 in the conveying direction, and discharges to the sheet discharge unit 12*a* the sheets P having passed the discharge areas Q1 to Q4. The sheet sensors 33*a* to 33*d* are disposed at or near respective upstream end edges of the discharge areas Q1 to Q4 to be located near the ink discharge heads 14*a* to 14*d*, respectively, and detect the sheets P.

The conveying unit 28 includes a pair of belt rollers 34 and 36, a circular conveying belt 38 stretched between the belt rollers 34 and 36, a tension roller 40 pressed against the conveying belt 38, and a platen 42 which horizontally supports a portion of the conveying belt 38 located on the upper side. Further, a rotary shaft 34*a* of the belt roller 34 on one side is connected to a rotary shaft 46*a* of a motor 46 via a gear unit 44.

The sheet feeding unit 30 includes a guide 48, a sheet feeding roller 50, a pair of feed rollers 52*a* and 52*b*, and a nip roller 54. The guide 48 forms a sheet feed path R1 for the sheets P. The sheet feeding roller 50 is provided near an upstream end portion of the guide 48, and feeds the sheets P stored in the sheet cassette 18 to the sheet feed path R1. The feed rollers 52*a* and 52*b* are provided on the sheet feed path R1. The nip roller 54 is provided near a downstream end portion of the guide 48, and presses the sheets P against a surface 38*a* of the conveying belt 38. Further, a rotary shaft 50*a* of the sheet feeding roller 50 is connected to a rotary shaft (illustration omitted) of a motor 55.

The sheet discharging unit 32 includes a guide 56, a separating plate 58, a pair of feed rollers 60*a* and 60*b*, and a pair of sheet discharging rollers 62*a* and 62*b*. The guide 56 forms a sheet discharge path R2. The separating plate 58 is provided near an upstream end portion of the sheet discharge path R2, and separates the sheets P from the surface 38*a* of the conveying belt 38. The feed rollers 60*a* and 60*b* are provided on the sheet discharge path R2. The sheet discharging rollers 62*a* and 62*b* are provided near a downstream end portion of the guide 56, and discharge the sheets P from the guide 56.

Figure 4:
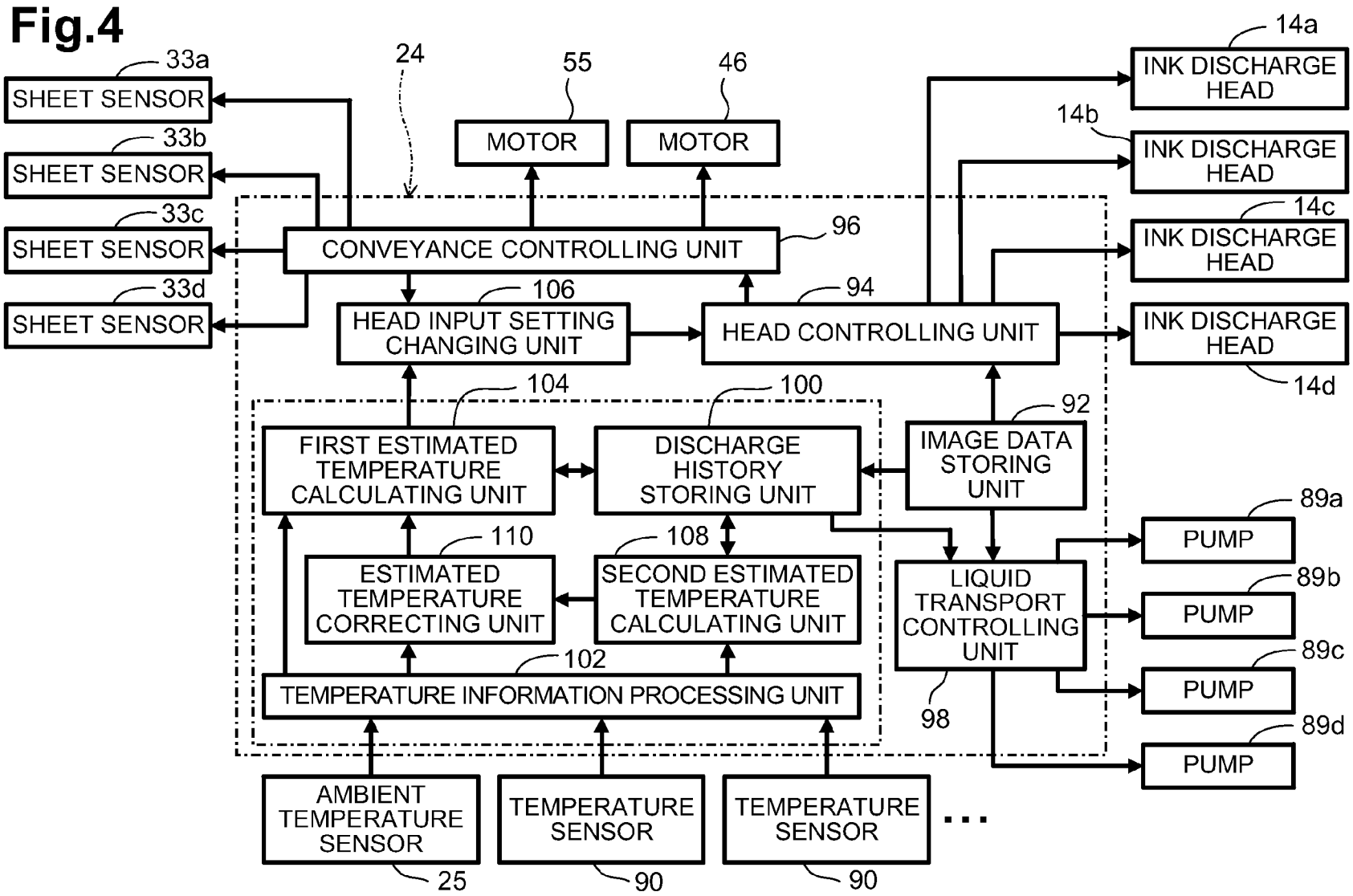
FIG. 4 is a block diagram illustrating a configuration of a controlling unit (head input setting changing unit) used in the inkjet printer.

The motor 46 of the conveying unit 28 (FIG. 1) and the motor 55 of the sheet feeding unit 30 (FIG. 1) are, for example, stepper motors or servomotors capable of performing highly accurate position control. As illustrated in FIG. 4, the motors 46 and 55 are electrically connected to the controlling unit 24. It is therefore possible to appropriately change a conveying speed V (FIG. 5) of the sheets P by causing the controlling unit 24 to control the motor 46 of the conveying unit 28, and to appropriately change intervals W1 to W3 (FIG. 5) between the sheets P by causing the controlling unit 24 to control the motor 55 of the sheet feeding unit 30.

Figure 5:
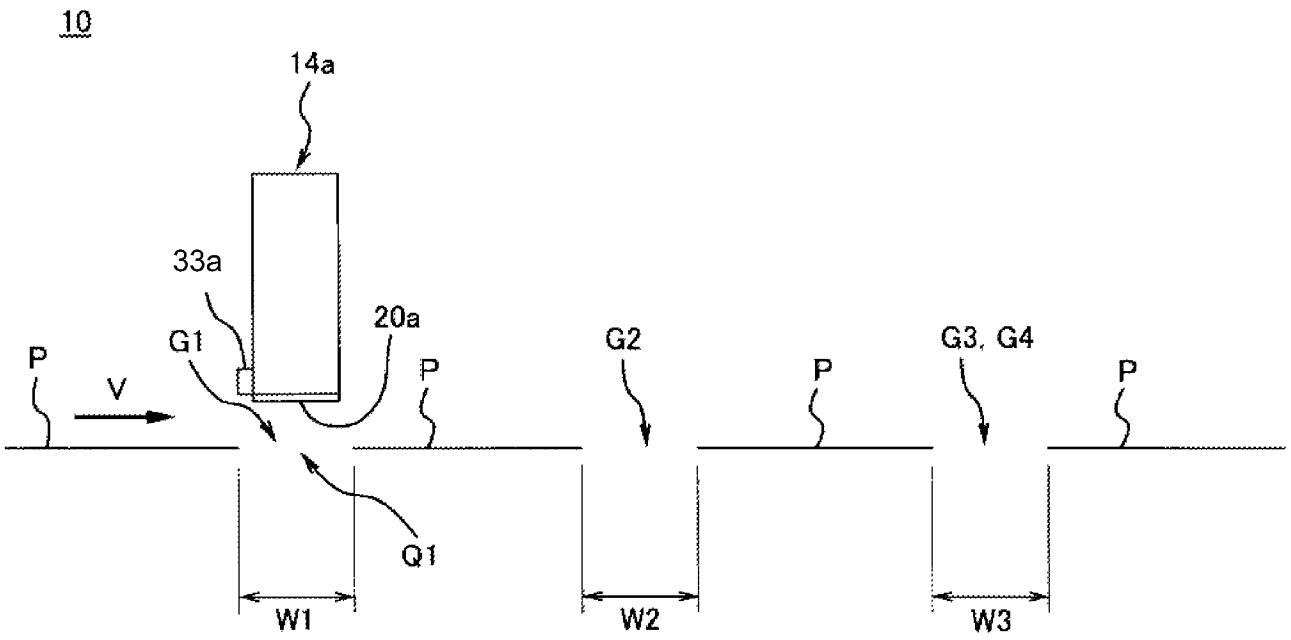
FIG. 5 is a front view schematically illustrating a positional relationship between the ink discharge head and gaps generated between a plurality of sheets (recording media)

Each of the sheet sensors 33*a* to 33*d* is a sensor which detects the sheets P in a non-contact manner, and is electrically connected to the controlling unit 24, as illustrated in FIG. 4. It is therefore possible to accurately measure the intervals W1 to W3 (FIG. 5) between the sheets P on the basis of the outputs from the sheet sensors 33*a* to 33*d*, the conveying speed V (FIG. 5) of the sheets P, and the time measured by a timer (illustration omitted), while the nozzle surface 20*a* is facing the gaps G1 to G3 (FIG. 5). The "gap" refers to an area between the sheets P, in which printing is not performed. In the present embodiment, the "gap" corresponds to an area between the sheets P, in which the sheets P are absent.

Configuration of Ink Discharge Head: As illustrated in FIG. 1, the ink discharge heads 14*a* to 14*d* discharge the respective inks, at the discharge areas Q1 to Q4, respectively, to the sheets P conveyed by the sheet conveying mechanism 22. Each of the ink discharge heads 14*a* to 14*d* includes a substantially rectangular parallelepiped-like head holder 70 and a head body 72 (shown in FIG. 2). The head holder 70 has longer sides extending in a direction perpendicular to the conveying direction (hereinafter referred to as the "sub-scanning direction") of the sheets P (hereinafter referred to as the "main scanning direction"). The head body 72 is attached to a lower surface of the head holder 70. That is, the inkjet printer 10 of the present embodiment is a line-type printer. In the present embodiment, all of the ink discharge heads 14*a* to 14*d* are similarly configured. In the following, therefore, description will be made only of the ink discharge head 14*a*, and description of the other ink discharge heads 14*b* to 14*d* will be omitted.

Figure 2:
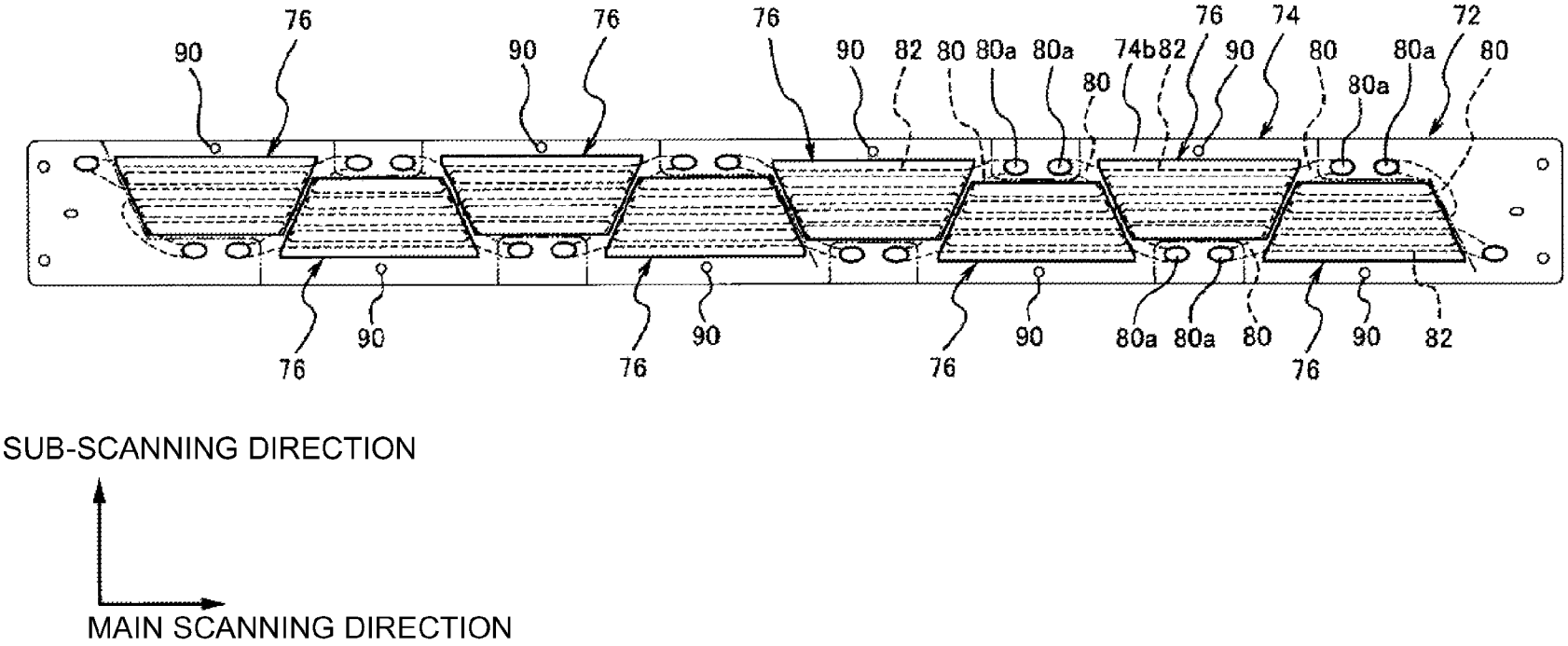
FIG. 2 is a plan view illustrating a head body of an ink discharge head (liquid discharge head) used in the inkjet printer.
Figure 3:
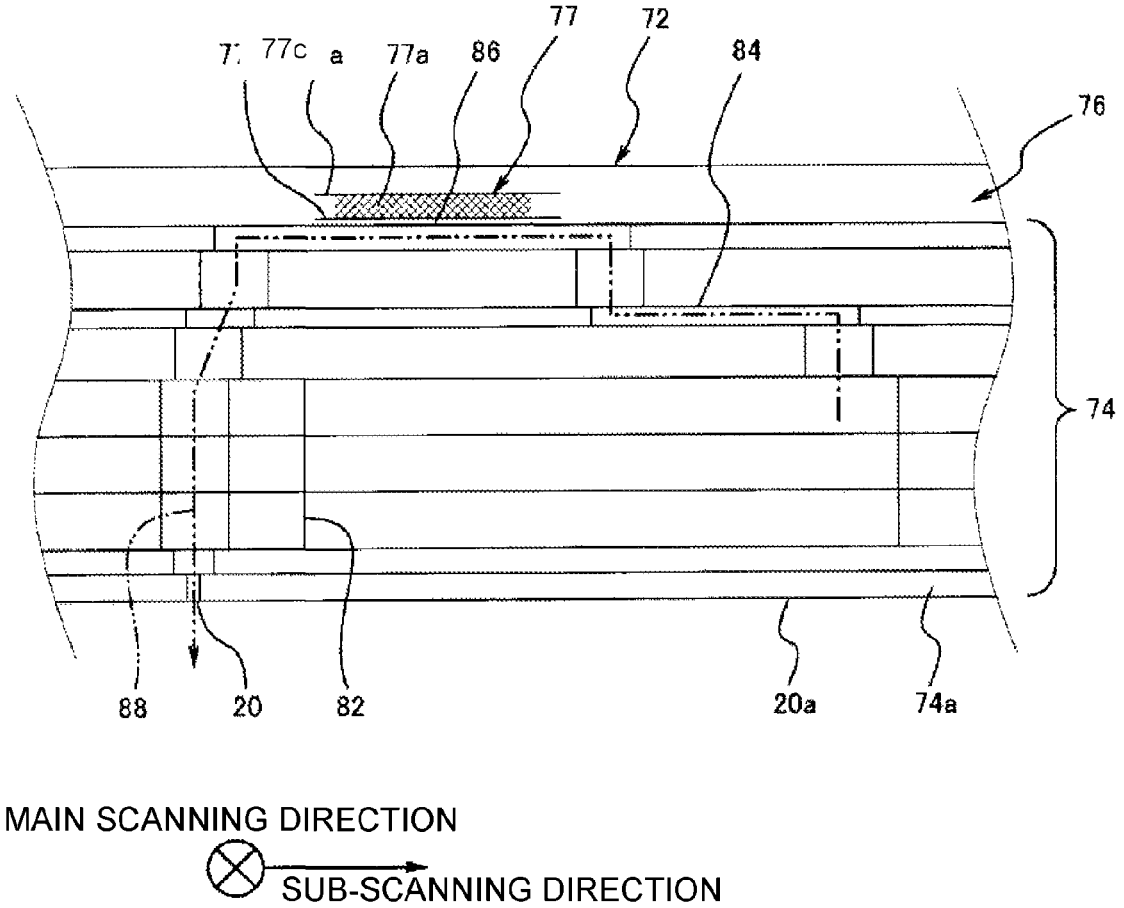
FIG. 3 is an enlarged partial cross-sectional view illustrating the head body of the ink discharge head.

As illustrated in FIG. 3, the head body 72 of the ink discharge head 14*a* includes a flow channel unit 74 and a plurality (eight in the present embodiment) of actuator units 76 joined to an upper surface of the flow channel unit 74. The flow channel unit 74 is a laminated body formed by a plurality of metal plates. A lower surface of a nozzle plate 74*a* forming the lowermost layer serves as the nozzle surface 20*a* provided with the plurality of nozzles 20. Further, as illustrated in FIG. 3, manifolds 80 (FIG. 2), sub-manifolds 82 communicating with the manifolds 80, and a plurality of separate ink flow channels 88 extending from the sub-manifolds 82 to the nozzles 20 through apertures 84 and pressure chambers 86 are formed inside the flow channel unit 74. As illustrated in FIG. 2, an upper surface 74*b* of the flow channel unit 74 is formed with a plurality of ink supply ports 80*a* communicating with the manifolds 80.

Further, although not illustrated, a reservoir unit for reserving the ink is disposed above the head body 72 (FIG. 1) in the head holder 70 (FIG. 1). The reservoir unit is connected to the ink tank 16*a* (FIG. 1) via a tube and a pump 89*a* (FIG. 4). As illustrated in FIG. 4, the pump 89*a* is electrically connected to the controlling unit 24. With the pump 89*a* controlled by the controlling unit 24, the ink reserved in the ink tank 16*a* (FIG. 1) is supplied to the reservoir unit of the ink discharge head 14*a* with predetermined timing. Other pumps 89*b* to 89*d* illustrated in FIG. 4 correspond to the ink discharge heads 14*b* to 14*d*, respectively.

As illustrated in FIG. 2, each of the plurality (eight in the present embodiment) of actuator units 76 is formed to have a substantially trapezoidal shape in a plan view. Mutually adjacent ones of the actuator units 76 are disposed in juxtaposition in the main scanning direction such that the respective upper or lower sides of the adjacent actuator units 76 are located on the mutually opposite sides. Further, respective portions located near or included in the plurality of actuator units 76 (the upper surface 74*b* of the flow channel unit 74 in the present embodiment) are provided with temperature sensors 90 each functioning as a "temperature sensor" for detecting the temperature of the corresponding actuator unit 76. The temperature sensors 90 are electrically connected to the controlling unit 24. The controlling unit 24 is therefore capable of grasping the temperature of the ink discharge head 14*a* for each of the actuator units 76 on the basis of the outputs from the temperature sensors 90. The actuator units 76 and the temperature sensors 90 are not necessarily required to correspond to each other in a one-to-one fashion, and a single common temperature sensor 90 may cover the plurality of actuator units 76.

As illustrated in FIG. 3, the plurality of actuator units 76 include a plurality of actuators 77 (indicated by grid lines in FIG. 3) corresponding to the pressure chambers 86 of the plurality of separate ink flow channels 88. Each of the actuators 77 includes a piezoelectric layer 77*a* and electrodes 77*b* and 77*c* disposed to sandwich the piezoelectric layer 77*a*. Further, one end portion of a flexible printed circuit (FPC) mounted with driver integrated circuits (ICs) is electrically connected to the respective electrodes 77*b* and 77*c* of the plurality of actuators 77. The other end portion of the FPC is electrically connected to the controlling unit 24 (FIG. 1). In the present embodiment, the actuators 77 of all of the actuator units 76 are electrically connected to the controlling unit 24 (FIG. 1) via a common FPC.

In the driver ICs (illustration omitted), a voltage waveform having a predetermined voltage value and a predetermined waveform is generated on the basis of a signal supplied by the controlling unit 24 (FIG. 1). In the actuator units 76, the actuators 77 are driven on the basis of the voltage waveform to discharge the ink from the nozzles 20. In some cases, therefore, a change in temperature occurs in the actuator units 76 owing to transmission of heat generated in the driver ICs (illustration omitted) or physical deformation of the actuators 77, and causes fluctuation of a discharge characteristic of the ink discharged from the nozzles 20 (FIG. 3). For example, if the ink discharge amount discharged to the sheets P is increased, the frequency of deformations of the actuators 77 is increased, and the heat generation amount of the driver ICs is increased. In some cases, therefore, the temperature of the actuator units 76 rises, and the ink discharge amount is unnecessarily increased. Meanwhile, if the ink discharge amount discharged to the sheets P is reduced (including a zero amount), the frequency of deformations of the actuators 77 is reduced (including zero times), and the heat generation amount of the driver ICs is reduced. If the ambient temperature $T_Z$ is lower than the temperature of the ink discharge head 14*a*, therefore, the temperature of the actuator units 76 falls and the ink discharge amount is unnecessarily reduced in some cases. In addition, the viscosity of ink in the nozzles 20 will decrease if the temperature of the actuator units 76 becomes high, therefore the temperature of the actuator units 76 rise and the ink discharge amount is unnecessarily increased, even if the energy inputted into the actuator units 76 is the same.

In view of the above, to suppress unnecessary fluctuation of the ink discharge amount, the present embodiment causes the controlling unit 24 to change at least one of the voltage value and the waveform (pulse width, for example) of the voltage waveform to be input to the ink discharge heads 14*a* to 14*d*.

Configuration of Controlling Unit: The controlling unit 24 (FIG. 1) is a computer including a not-illustrated central processing unit (CPU) (including a timer), a nonvolatile memory which rewritably stores a control program executed by the CPU and a variety of data, and a random access memory (RAM) which temporarily stores data in the execution of a program. Further, as illustrated in FIG. 4, the control program executed by the CPU and the nonvolatile memory or the RAM realize an image data storing unit 92, a head controlling unit 94, a conveyance controlling unit 96, a liquid transport controlling unit 98, a discharge history storing unit 100, a temperature information processing unit 102, a first estimated temperature calculating unit 104, a head input setting changing unit 106, a second estimated temperature calculating unit 108, and an estimated temperature correcting unit 110. In addition, the controlling unit 24 may be constituted by ASIC (Application Specific Integrated Circuit) or a FPGA (Field-Programmable Gate Array).

The image data storing unit 92 stores image data transmitted from, for example, a personal computer. In general, image data has density values of colors corresponding to respective pixels arranged in a matrix corresponding to a print area of a sheet P. Further, after being stored in the image data storing unit 92, the image data is converted into data corresponding to the ink discharge heads 14*a* to 14*d*. Specifically, the image data is converted, for each of the pixels, into discharge amount data which indicates the amount of the ink to be discharged from the nozzles 20 (FIG. 3) in four levels of zero, small, medium, and large droplet amounts.

The head controlling unit 94 controls the voltage value and the waveform of the voltage waveform to be input to the ink discharge heads 14*a* to 14*d* (FIG. 1) such that a predetermined amount of ink according to the discharge amount data is discharged to positions in the sheet P corresponding to the respective pixels. For example, the head controlling unit 94 controls the voltage value such that the voltage value is increased in accordance with the increase of the ink discharge amount (zero, small, medium, or large droplet amount) read from the discharge amount data. Alternatively, on the basis of a control signal transmitted from the head controlling unit 94, the driver ICs provided in the ink discharge heads 14*a* to 14*d* generate a voltage waveform corresponding to the ink discharge amount (zero, small, medium, or large droplet amount) read from the discharge amount data. The head controlling unit 94 may simultaneously control both of the voltage value and the waveform of the voltage waveform, not just controlling one of the voltage value and the waveform. Herein, the control of the voltage waveform (the voltage value and the waveform) is a commonly used control required for a normal printing operation.

The conveyance controlling unit 96 controls the motor 46 of the conveying unit 28 (FIG. 1) and the motor 55 of the sheet feeding unit 30 (FIG. 1) to convey the sheets P to the discharge areas Q1 to Q4 (FIG. 1) with predetermined timing and appropriately change the conveying speed V (FIG. 5) of the sheets P and the intervals W1 to W3 (FIG. 5) between the sheets P. The liquid transport controlling unit 98 controls the operation of the pumps 89*a* to 89*d* to supply the respective inks to the respective reservoir units of the ink discharge heads 14*a* to 14*d*. The discharge history storing unit 100 stores a "discharge history" of the ink discharge heads 14*a* to 14*d*. Herein, the "discharge history" refers to a history relating to ink discharge conditions of the ink discharge heads 14*a* to 14*d*. Specifically, the respective ink discharge amounts discharged from the ink discharge heads 14*a* to 14*d* and the dot counts of the respective inks in the ink discharge heads 14*a* to 14*d* form the "discharge history." The "discharge history" is generated on the basis of the image data (discharge amount data) stored in the image data storing unit 92.

The temperature information processing unit 102 acquires temperature information from respective signals output from the ambient temperature sensor 25 and the plurality of temperature sensors 90. The first estimated temperature calculating unit 104 functions for calculating a first estimated temperature $t_1$ (estimated temperature) of each of the ink discharge heads 14*a* to 14*d* corresponding to the time in which the nozzle surface 20*a* is facing the first gap G1. On the basis of a first actual temperature $T_1$ (actual temperature) of each of the ink discharge heads 14*a* to 14*d* acquired by the temperature information processing unit 102 while the nozzle surface 20*a* is facing the second gap G2 (FIG. 5) and the discharge history (ink discharge amount, for example) of the ink discharged to the sheet P located between the first gap G1 and the second gap G2, the first estimated temperature calculating unit 104 calculates the first estimated temperature $t_1$ of each of the ink discharge heads 14*a* to 14*d* corresponding to the time in which the nozzle surface 20*a* is facing the first gap G1. The first estimated temperature $t_1$ is calculated by a look-up table which contains a combination of the first actual temperature $T_1$ and the discharge history. In addition, a calculation formula may be used instead of a look-up table, and the first estimated temperature $t_1$ may be calculated.

For example, as illustrated in FIG. 5, as to one of the actuator units 76 of the ink discharge head 14*a*, if the ink discharge amount discharged to the sheet P located between the first gap G1 and the second gap G2 is used as the "discharge history," the value of the first estimated temperature $t_1$ of the ink discharge head 14*a* corresponding to the time in which the nozzle surface 20*a* is facing the first gap G1 is increased to be higher than the first actual temperature $T_1$ in accordance with the increase of the ink discharge amount. Therefore, the first estimated temperature calculating unit 104 calculates the first estimated temperature $t_1$ to be higher than the first actual temperature $T_1$ such that the difference in temperature between the first estimated temperature $t_1$ and the first actual temperature $T_1$ is increased in accordance with the increase of the ink discharge amount. Further, it is considered that a temperature rise amount between the second gap G2 and the first gap G1 is increased in accordance with the increase of a temperature rise amount between the second gap G2 and the third gap G3 located downstream of the second gap G2 in the conveying direction. Therefore, the first estimated temperature calculating unit 104 calculates the first estimated temperature $t_1$ such that the first estimated temperature $t_1$ is increased in accordance with the increase of the temperature rise amount between the third gap G3 and the second gap G2. It is thereby possible to make the first estimated temperature $t_1$ approach an actual temperature $T_0$ (temperature) of the ink discharge head 14*a* measured while the nozzle surface 20*a* is facing the first gap G1.

Further, the first actual temperature $T_1$ of the ink discharge heads 14*a* to 14*d* is also affected by the ambient temperature $T_Z$. Therefore, the first estimated temperature calculating unit 104 corrects the value such that the first estimated temperature $t_1$ is increased if the ambient temperature $T_Z$ is higher than the first actual temperature $T_1$ and the difference between the two temperatures is increased. Conversely, the first estimated temperature calculating unit 104 corrects the value such that the first estimated temperature $t_1$ is reduced if the ambient temperature $T_Z$ is lower than the first actual temperature $T_1$ and the difference between the two temperatures is increased. The combinations of the first actual temperature $T_1$, the ink discharge amount, and the ambient temperature $T_Z$, and the values of the first estimated temperature $t_1$ are previously stored in the nonvolatile memory as the look-up table or the calculation formula, and are used to calculate the first estimated temperature $t_1$.

The head input setting changing unit 106 functions as "head input setting changing unit" for changing, on the basis of the first estimated temperature $t_1$, the setting of at least one of the voltage value and the waveform of the voltage waveform to be input to the ink discharge heads 14*a* to 14*d*, while the nozzle surface 20*a* is facing the first gap G1 of the plurality of gaps G1 to G3 generated between the plurality of sheets P conveyed by the sheet conveying mechanism 22 functioning as "recording medium conveying unit." It is considered that the ink discharge amount is unnecessarily increased in the ink discharge heads 14*a* to 14*d* in accordance with the increase of the first estimated temperature $t_1$. Further, it is considered that, if the ambient temperature $T_Z$ is lower than the temperature of the ink discharge heads 14*a* to 14*d*, the ink discharge amount is unnecessarily reduced in accordance with the reduction of the first estimated temperature $t_1$. Therefore, the head input setting changing unit 106 controls the voltage value of the voltage waveform such that the voltage value is reduced in accordance with the increase of the first estimated temperature $t_1$, and controls the voltage value of the voltage waveform such that the voltage value is increased in accordance with the reduction of the first estimated temperature $t_1$. Alternatively, the head input setting changing unit 106 changes the setting to generate a voltage waveform which reduces the ink discharge amount in accordance with the increase of the first estimated temperature $t_1$, or changes the setting to select, from the voltage waveforms stored in the nonvolatile memory, a voltage waveform which reduces the ink discharge amount in accordance with the increase of the first estimated temperature $t_1$. Further, the head input setting changing unit 106 changes the setting to generate a voltage waveform which increases the ink discharge amount in accordance with the reduction of the first estimated temperature $t_1$, or changes the setting to select, from the voltage waveforms stored in the nonvolatile memory, a voltage waveform which increases the ink discharge amount in accordance with the reduction of the first estimated temperature $t_1$. The voltage waveform which reduces or increases the ink discharge amount refers to a voltage waveform which reduces or increases the ink discharge amount as compared with the voltage waveform at the first actual temperature $T_1$ (reference temperature). With this configuration, the actually discharged ink discharge amount is kept substantially constant regardless of the temperature. It is therefore possible to suppress excessive fluctuation of the ink discharge amount and thereby suppress fluctuation of the print density. As to which one of the voltage value and the waveform should be controlled, the setting may be changed as appropriate. Only one of the voltage value and the waveform may be controlled, or both thereof may be controlled.

The head input setting changing unit 106 also functions as "facing time detecting unit" for detecting (calculating) the duration of a state in which the nozzle surface 20*a* is facing the first gap G1 (hereinafter referred to as the "facing time"). The intervals W1 to W3 of the sheets P are determined as the image data stored in the image data storing unit 92 or initial values of the inkjet printer 10, and are normally set to a constant value. The head input setting changing unit 106 detects (calculates) the facing time on the basis of the image data stored in the image data storing unit 92 or the initial values of the inkjet printer 10 and the conveying speed V (FIG. 5) of the sheets P.

In the present embodiment, the temperature sensor 90 functioning as "first head temperature measuring unit" is provided for each of the plurality of actuator units 76. Therefore, the first estimated temperature calculating unit 104 calculates the first estimated temperature $t_1$ for each of the plurality of actuator units 76, and the head input setting changing unit 106 controls the setting of at least one of the voltage value and the waveform of the voltage waveform for each of the plurality of actuator units 76.

In a normal printing operation, the first estimated temperature $t_1$ is calculated in the first estimated temperature calculating unit 104, as described above. To more appropriately adjust the voltage value and the waveform, however, it is desirable to correct the first estimated temperature $t_1$ in accordance with the difference between the first estimated temperature $t_1$ and the actual temperature $T_0$ such that the first estimated temperature $t_1$ approaches the actual temperature $T_0$. Therefore, the estimated temperature correcting unit 110 functioning as "estimated temperature correcting unit" corrects the first estimated temperature $t_1$ such that the first estimated temperature $t_1$ approaches the actual temperature $T_0$. That is, the temperature sensor 90 measures a second actual temperature $T_2$ (previous actual temperature) of the ink discharge head 14*a* while the nozzle surface 20*a* is facing a fourth gap G4 (the same as the third gap G3 in the present embodiment) located downstream of the second gap G2 in the conveying direction. Further, the second estimated temperature calculating unit 108 (FIG. 4) calculates, on the basis of the second actual temperature $T_2$ and a previous discharge history (ink discharge amount, for example) of the ink discharged to the sheet P located between the second gap G2 and the fourth gap G4, a second estimated temperature t2 (previous estimated temperature) of the ink discharge head 14*a* corresponding to the time in which the nozzle surface 20*a* is facing the second gap G2. Further, the estimated temperature correcting unit 110 functioning as the "estimated temperature correcting unit" corrects, on the basis of the difference between the second estimated temperature $t_2$ and the second actual temperature $T_2$, the first estimated temperature $t_1$ calculated by the first estimated temperature calculating unit 104. For example, if the second estimated temperature $t_2$ is higher than the second actual temperature $T_2$, the first estimated temperature $t_1$ is also considered to be higher than the first actual temperature $T_1$ by a similar degree. Therefore, the estimated temperature correcting unit 110 functioning as the "estimated temperature correcting unit" corrects the first estimated temperature $t_1$ such that the first estimated temperature $t_1$ is higher than the value calculated by the first estimated temperature calculating unit 104. If the ink discharge amount substantially changes, the estimated temperature correcting unit 110 corrects the first estimated temperature $t_1$ by also taking the fluctuation of the ink discharge amount into account.

Figure 6:
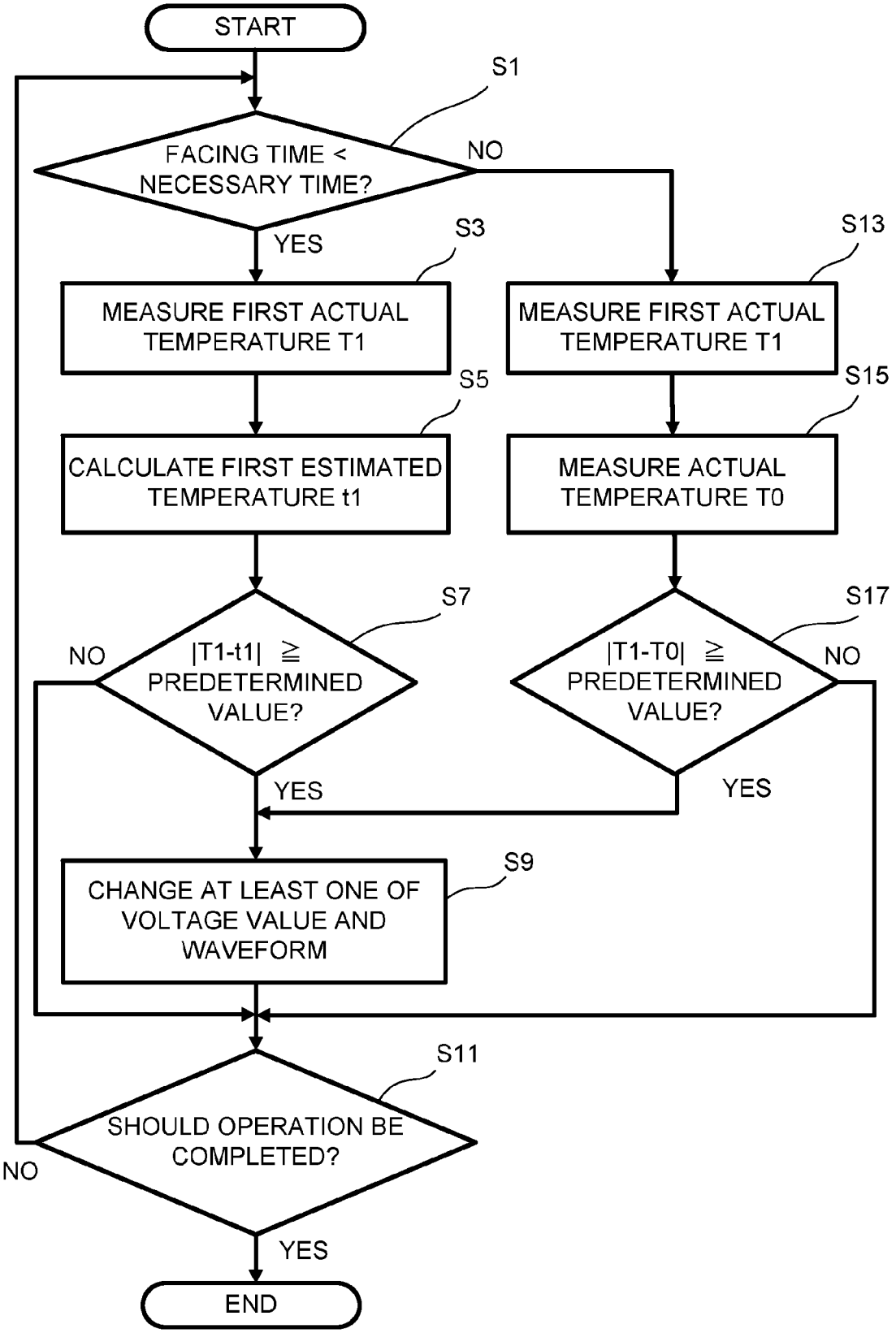
FIG. 6 is a flowchart illustrating a controlling operation of the controlling unit (computer)

Controlling Operation of Controlling Unit: A controlling operation of the controlling unit (computer) 24 on an ink discharge head 14*a* illustrated in FIG. 5 will be described below in accordance with the flowchart of FIG. 6. As illustrated in FIG. 6, it is determined at Step S1 whether or not the facing time detected by the head input setting changing unit 106 functioning as the "facing time detecting unit" is less than the time required to measure the actual temperature $T_0$ of the ink discharge head 14*a* and change the voltage waveform (at least one of the voltage value and the waveform) (hereinafter referred to as the "necessary time"). If the facing time is less than the necessary time, a "YES" determination is made. If the facing time is equal to or more than the necessary time, a "NO" determination is made.

Then, if a "YES" determination is made at Step S1, the first actual temperature $T_1$ of the ink discharge head 14*a* corresponding to the time in which the nozzle surface 20*a* is facing the second gap G2 is measured at Step S3, and the first estimated temperature $t_1$ of the ink discharge head 14*a* corresponding to the time in which the nozzle surface 20*a* is facing the first gap G1 is calculated at Step S5. In addition, Step S5 is completed even before the nozzle surface 20*a* is facing the first gap G1. Thereafter, it is determined at Step S7 whether or not the difference between the first actual temperature $T_1$ and the first estimated temperature $t_1$ is equal to or greater than a first predetermined value. If a "YES" determination is made, the setting of at least one of the voltage value and the waveform of the voltage waveform is changed at Step S9. In addition, Step S9 is performed while the nozzle surface 20*a* is facing the first gap G1. Thereafter, the procedure proceeds to Step S11. Meanwhile, if a "NO" determination is made, the procedure directly proceeds to Step S11. At Step S11, whether or not to complete the controlling operation is determined. If it is determined to continuously perform the printing operation on the sheet P, a "NO" determination is made, and the procedure returns to Step S1. If it is determined to complete the printing operation, a "YES" determination is made, and the controlling operation is completed. The first predetermined value is a value beforehand set up from an experiment. Two or more first predetermined values are set up, each corresponding to a different first actual temperature $T_1$, and these values are stored in the nonvolatile memory. The first predetermined value is defined as a temperature difference where there is not an unacceptable deterioration in the image. If the difference between the actual temperature and the estimated temperature is less than the first predetermined value, then the setting of the voltage waveform is not changed by the head input setting changing unit. If the difference is equal to or greater than the first predetermined value, the head input setting changing unit changes the setting of the voltage waveform.

If a "NO" determination is made at Step S1, the first actual temperature $T_1$ is measured at Step S13, and the actual temperature $T_0$ is measured at Step S15. The actual temperature $T_0$ is the actual temperature of the ink discharge head 14*a* measured while the nozzle surface 20*a* is facing the first gap G1. The actual temperature $T_0$ is directly detected by the temperature sensors 90. Thereafter, it is determined at Step S17 whether or not the difference between the first actual temperature $T_1$ and the actual temperature $T_0$ is equal to or greater than a second predetermined value. If a "YES" determination is made, the procedure proceeds to Step S9. If a "NO" determination is made, the procedure proceeds to Step S11. The second predetermined value as well as the first predetermined value is beforehand set up from an experiment, and is stored in the nonvolatile memory. In this embodiment, the second predetermined value is the same value as the first predetermined value.

As described above, the head input setting changing unit 106 functioning as the "head input setting changing unit" changes the setting of at least one of the voltage value and the waveform of the voltage waveform, when the difference between the first actual temperature $T_1$ and the first estimated temperature $t_1$ is equal to or greater than the first predetermined value (Step S9). It is therefore possible to prevent frequent changes of the setting of the voltage value and the waveform and thereby reduce the power consumption. Further, the head input setting changing unit 106 functioning as the "head input setting changing unit" changes the setting of at least one of the voltage value and the waveform by using the actual temperature $T_0$ in place of the first estimate temperature $t_1$, when the facing time is equal to or more than the necessary time (Steps S13 to S17 and Step S9). It is therefore possible to more appropriately change the setting of at least one of the voltage value and the waveform of the voltage waveform on the basis of the actual temperature $T_0$ of the ink discharge head 14*a*, when the facing time is equal to or more than the necessary time.

At Step S9, if the ink discharge amount discharged to the sheet P located between the first gap G1 and the second gap G2 is equal to or greater than a third predetermined value, the head input setting changing unit 106 functioning as the "head input setting changing unit" may control the voltage waveform to reduce the voltage value, generate a voltage waveform which reduces the ink discharge amount, or select, from the voltage waveforms stored in the nonvolatile memory, a voltage waveform which reduces the ink discharge amount. Further, if the ambient temperature $T_Z$ is equal to or lower than a fourth predetermined value, the head input setting changing unit 106 functioning as the "head input setting changing unit" may increase the voltage value, change the setting to generate a voltage waveform which increases the ink discharge amount, or change the setting to select, from the voltage waveforms stored in the nonvolatile memory, a voltage waveform which increases the ink discharge amount. Further, if the ambient temperature $T_Z$ is equal to or higher than a fifth predetermined value, the head input setting changing unit 106 functioning as the "head input setting changing unit" may reduce the voltage value, change the setting to generate a voltage waveform which reduces the ink discharge amount, or change the setting to select, from the voltage waveforms stored in the nonvolatile memory, a voltage waveform which reduces the ink discharge amount.

For example, if the ink discharge amount is equal to or greater than the third predetermined value, the temperature of the ink discharge head 14*a* rises to a predetermined temperature or higher, and the ink discharge amount is unnecessarily increased. Therefore, the ink discharge amount is suppressed by the reduction of the voltage value, the generation of a voltage waveform which reduces the ink discharge amount, or the selection, from the voltage waveforms stored in the nonvolatile memory, a voltage waveform which reduces the ink discharge amount. It is thereby possible to adjust the ink discharge amount to an appropriate value. The third predetermined value is a value beforehand set up from an experiment. Two or more third predetermined values are set up, each corresponding to a different first actual temperature $T_1$, and these values are stored in the nonvolatile memory. The third predetermined value is set as the value changed to the difference in temperature by which the temperature of the ink discharge head 14*a* is equivalent to the first predetermined value with the heat which arises by ink discharge. Further, for example, if the ambient temperature $T_Z$ is equal to or lower than the fourth predetermined value, the temperature of the ink discharge head 14*a* falls to a predetermined temperature or lower, and the ink discharge amount is unnecessarily reduced. Therefore, the ink discharge amount is increased by the increase of the voltage value, the generation of a voltage waveform which increases the ink discharge amount, or the selection, from the voltage waveforms stored in the nonvolatile memory, a voltage waveform which increases the ink discharge amount. It is thereby possible to adjust the ink discharge amount to an appropriate value. The fourth predetermined value is a value beforehand set up from an experiment. Two or more forth predetermined values are set up, each corresponding to a different first actual temperature $T_1$, and these values are stored in the nonvolatile memory. Further, for example, if the ambient temperature $T_Z$ is equal to or higher than the fifth predetermined value, the temperature of the ink discharge head 14*a* rises to a predetermined temperature or higher, and the ink discharge amount is unnecessarily increased. Therefore, the ink discharge amount is suppressed by the reduction of the voltage value, the generation of a voltage waveform which reduces the ink discharge amount, or the selection, from the voltage waveforms stored in the nonvolatile memory, a voltage waveform which reduces the ink discharge amount. It is thereby possible to adjust the ink discharge amount to an appropriate value. The fifth predetermined value is a value beforehand set up from an experiment. Two or more fifth predetermined values are set up, each corresponding to a different first actual temperature $T_1$, and these values are stored in the nonvolatile memory.

Second Embodiment

Figure 7:
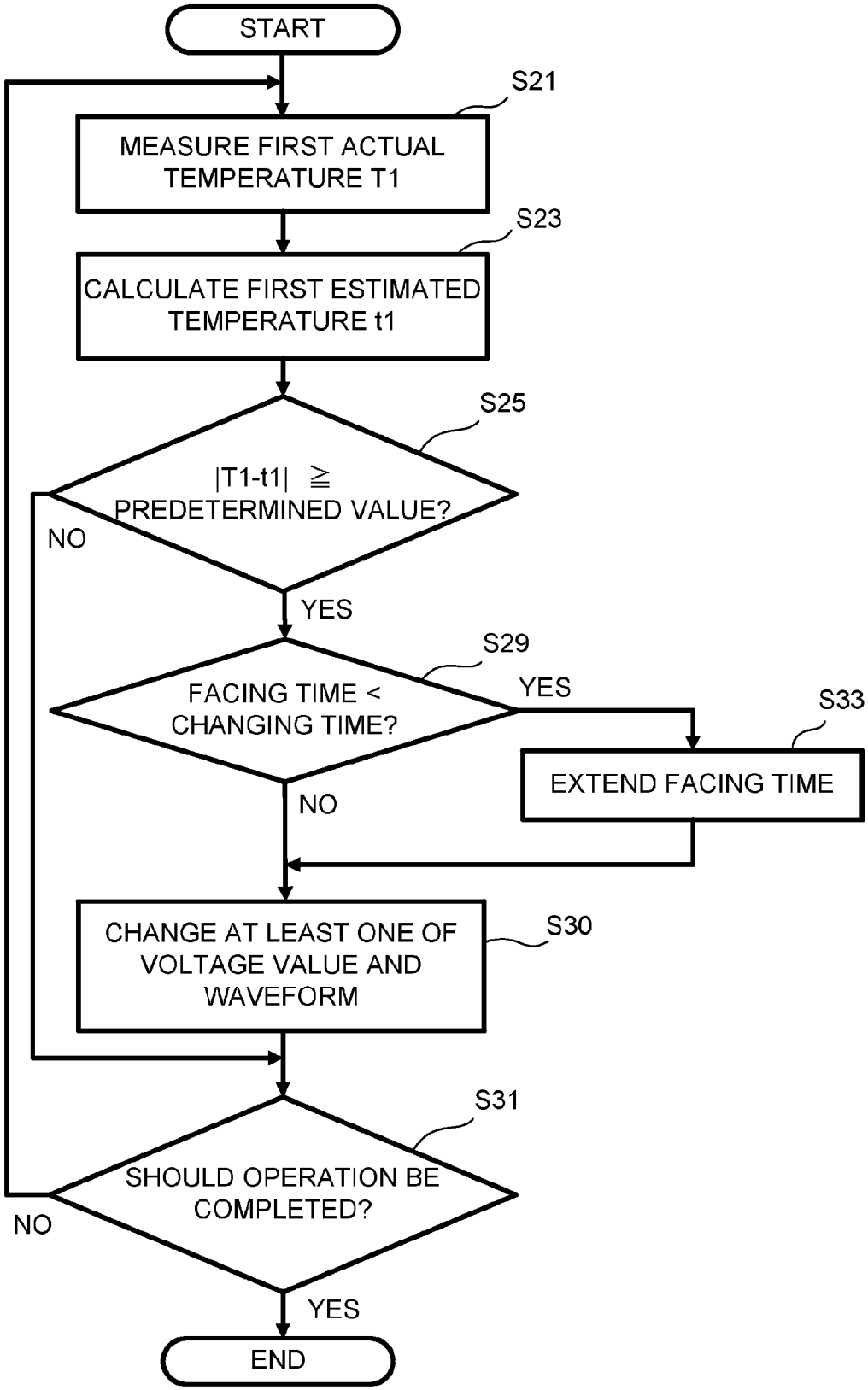
FIG. 7 is a flowchart illustrating a controlling operation of a controlling unit (computer) of an inkjet printer (liquid discharge apparatus) according to a second embodiment.

FIG. 7 is a flowchart illustrating a controlling operation of a controlling unit (computer) in an inkjet printer according to a second embodiment. The controlling operation of the controlling unit on an ink discharge head 14*a* illustrated in FIG. 5 will be described below in accordance with the flowchart of FIG. 7. As illustrated in FIG. 7, in the second embodiment, the first actual temperature $T_1$ is first measured at Step S21, and the first estimated temperature $t_1$ is calculated at Step S23. Thereafter, it is determined at Step S25 whether or not the difference between the first actual temperature $T_1$ and the first estimated temperature $t_1$ is equal to or greater than a sixth predetermined value. The sixth predetermined value is the same value as the first predetermined value.

If a "YES" determination is made at Step S25, the procedure proceeds to Step S29. At Step S29, it is determined whether or not the facing time detected by the head input setting changing unit 106 functioning as the "facing time detecting unit" is less than the time required to change the setting of the voltage waveform (at least one of the voltage value and the waveform) (hereinafter referred to as the "changing time"). In addition, Step S29 is completed even before the nozzle surface 20*a* is facing the first gap G1. Then, if a "YES" determination is made, a process of extending the facing time is performed at Step S33, and thereafter the procedure proceeds to Step S30. If a "NO" determination is made, the procedure directly proceeds to Step S30. Then, the setting of at least one of the voltage value and the waveform of the voltage waveform is changed at Step S30. In addition, Step S30 is performed while the nozzle surface 20*a* is facing the first gap G1. Thereafter, the procedure proceeds to Step S31.

In the process of extending the facing time, the head input setting changing unit 106 functioning as the "facing time detecting unit" detects the facing time in which the nozzle surface 20*a* is facing the first gap G1. Further, if the facing time is less than the time required to change the setting of at least one of the voltage value and the waveform of the voltage waveform, the conveyance controlling unit 96 functioning as "conveying speed controlling unit" temporarily reduces the conveying speed V to thereby extend the facing time. Alternatively, if the facing time is less than the time required to change the setting of at least one of the voltage value and the waveform of the voltage waveform, the conveyance controlling unit 96 functioning as "conveyance interval controlling unit" temporarily increases the conveyance interval W1 (FIG. 5) to thereby extend the facing time.

Meanwhile, if a "NO" determination is made at Step S25, the procedure directly proceeds to Step S31. At Step S31, whether or not to complete the controlling operation is determined. If it is determined to continuously perform the printing operation on the sheet P, a "NO" determination is made, and the procedure returns to Step S21. If it is determined to complete the printing operation, a "YES" determination is made, and the controlling operation is completed.

In the second embodiment, the process of extending the facing time is performed to temporarily extend the facing time, only when it is difficult to change the setting of the voltage waveform (at least one of the voltage value and the waveform) within the facing time. Even if the printing speed is increased, therefore, it is possible to appropriately perform the setting of at least one of the voltage value and the waveform of the voltage waveform, while maintaining a high printing speed.

Other Embodiments

In the above-described embodiments, the "liquid discharge apparatus" according to an embodiment of the present invention is applied to the inkjet printer which discharges ink. In another embodiment, the "liquid discharge apparatus" according to an embodiment of the present invention may be applied to a processing liquid discharge apparatus which discharges a processing liquid or a liquid discharge apparatus which discharges another liquid. Further, as to the liquid discharging method, the method using actuators may be replaced by a method of discharging a liquid by using pressure generated when the volume of the liquid is expanded by a heat generating element. Further, the "liquid discharge apparatus" according to an embodiment of the present invention may be applied to a serial printer in place of the above-described line printer.

In the above-described embodiments, the first actual temperature $T_1$ is measured while the nozzle surface 20*a* is facing the first gap G1. This is based on consideration that, if an ink discharge head 14 is performing the discharging operation, noise may be generated in a circuit of the inkjet printer 10 owing to the driving of the ink discharge head 14 and prevent accurate measurement of the first actual temperature $T_1$. In the above-described embodiments, therefore, the actual temperature is measured while the nozzle surface 20*a* is facing a gap between the sheets P, in which the sheets P are absent. However, the actual temperature may be measured while the nozzle surface 20*a* is facing a sheet P, unless the ink discharge head 14 is performing the discharging operation. In this case, the "gap" includes not only the area between the sheets P, in which the sheets P are absent, but also an area in an end portion of the sheet P, in which printing is not performed.

What is claimed is:

1. A liquid discharge apparatus comprising:

a liquid discharge head having a nozzle surface including nozzles for discharging liquid, the liquid discharge head being configured to receive a voltage signal having a waveform for discharging the liquid from the nozzles;

a recording medium conveying unit being configured to successively convey a plurality of recording media in a conveying direction, the plurality of recording media being conveyed with a plurality of gaps between each recording medium;

a temperature sensor configured to output first temperature information and second temperature information, the first temperature information is temperature information of a first actual temperature of the liquid discharge head while the nozzle surface is facing a second gap of the plurality of gaps located downstream of a first gap of the plurality of gaps in the conveying direction, the second temperature information is temperature information of a second actual temperature of the liquid discharge head while the nozzle surface is facing a third gap of the plurality of gaps located downstream of the second gap of the plurality of gaps in the conveying direction;

a controller configured to:

determine, based on the first temperature information of the first actual temperature received from the temperature sensor and the second temperature information of the second actual temperature received from the temperature sensor, a temperature rise amount between the first actual temperature and the second actual temperature;

determine, based on the first temperature information of the first actual temperature received from the temperature sensor, the temperature rise amount and a discharge history relating to the liquid discharged from the liquid discharge head to the recording medium between the first gap and the second gap, an estimated temperature of the liquid discharge head before the nozzle surface faces the first gap; and determine the waveform based on the estimated temperature, while the nozzle surface is facing the first gap, wherein the controller is further configured to determine the estimated temperature such that the estimated temperature is increased in accordance with the increase of the temperature rise amount.

2. The liquid discharge apparatus according to claim 1, wherein the discharge history includes a liquid discharge amount discharged from the liquid discharge head.

3. The liquid discharge apparatus according to claim 1, wherein the controller is further configured to determine the waveform when a difference between the first actual temperature and the estimated temperature is equal to or greater than a predetermined value, the waveform including one or more of: a voltage value, and/or a shape of a voltage pulse.

4. The liquid discharge apparatus according to claim 1, wherein the controller is further configured to reduce a voltage value of the waveform, when a liquid discharge amount discharged to the recording medium between the first gap and the second gap is equal to or greater than a predetermined value.

5. The liquid discharge apparatus according to claim 1, wherein the controller is further configured to increase a voltage value of the waveform, when an ambient temperature is equal to or lower than a predetermined value.

6. The liquid discharge apparatus according to claim 1, wherein the controller is further configured to determine the estimated temperature based on an ambient temperature.

7. The liquid discharge apparatus according to claim 1, wherein the temperature sensor is further configured to output temperature information of a temperature of the liquid discharge head while the nozzle surface is facing the first gap;

the controller is further configured to:

determine a facing time in which the nozzle surface is facing the first gap, and determine at least one of a voltage value and a shape of the waveform based on the temperature instead of the estimated temperature when the facing time is equal to or more than the time required to measure an actual temperature of the liquid discharge head.

8. The liquid discharge apparatus according to claim 1, wherein the controller is further configured to:

determine a facing time in which the nozzle surface is facing the first gap; and reduce a conveying speed of the recording media to thereby extend the facing time when the facing time is less than the time required to change at least one of the voltage value and the shape of the waveform.

9. The liquid discharge apparatus according to claim 1, wherein the controller is further configured to:

determine a facing time in which the nozzle surface is facing the first gap; and increase a conveyance interval between the recording media to thereby extend the facing time when the facing time is less than the time required to change at least one of the voltage value and the shape of the voltage waveform.

10. A storage device for computer-readably storing a computer-executable program executable by a processor of a liquid discharge apparatus including a liquid discharge head having a nozzle surface including nozzles for discharging liquid, the liquid discharge head being configured to receive a signal having a waveform for discharging the liquid from the nozzles, recording medium conveying unit being configured to successively convey a plurality of recording media in a conveying direction, the plurality of recording media being conveyed with a plurality of gaps between each recording medium, a temperature sensor configured to output first temperature information and second temperature information, the first temperature information is temperature information of a first actual temperature of the liquid discharge head while the nozzle surface is facing a second gap of the plurality of gaps located downstream of a first gap of the plurality of gaps in the conveying direction, the second temperature information is temperature information of a second actual temperature of the liquid discharge head while the nozzle surface is facing a third gap of the plurality of gaps located downstream of the second gap of the plurality of gaps in the conveying direction, the program causing the processor to execute functions comprising:

determining, based on the first temperature information of the first actual temperature received from the temperature sensor and the second temperature information of the second actual temperature received from the temperature sensor, a temperature rise amount between the first actual temperature and the second actual temperature;

determining, based on the first temperature information of the first actual temperature received from the temperature sensor, the temperature rise amount and a discharge history relating to the liquid discharged from the liquid discharge head to the recording medium between the first gap and the second gap, an estimated temperature such that the estimated temperature is increased in accordance with the increase of the temperature rise amount, the estimated temperature is an estimated temperature of the liquid discharge head before the nozzle surface faces the first gap; and determining the waveform based on the estimated temperature, while the nozzle surface is facing the first gap.

11. A method for discharging a liquid from a liquid discharge apparatus including a liquid discharge head having a nozzle surface including nozzles for discharging liquid, the liquid discharge head being configured to receive a signal having a waveform for discharging the liquid from the nozzles, recording medium conveying unit being configured to successively convey a plurality of recording media in a conveying direction, the plurality of recording media being conveyed with a plurality of gaps between each recording medium, a temperature sensor configured to output first temperature information and second temperature information, the first temperature information is temperature information of a first actual temperature of the liquid discharge head while the nozzle surface is facing a second gap of the plurality of gaps located downstream of a first gap of the plurality of gaps in the conveying direction, the second temperature information is temperature information of a second actual temperature of the liquid discharge head while the nozzle surface is facing a third gap of the plurality of gaps located downstream of the second gap of the plurality of gaps in the conveying direction, the method comprising the steps of:

determining, based on the first temperature information of the first actual temperature received from the temperature sensor and the second temperature information of the second actual temperature received from the temperature sensor, a temperature rise amount between the first actual temperature and the second actual temperature;

determining, based on the first temperature information of the first actual temperature received from the temperature sensor, the temperature rise amount and a discharge history relating to the liquid discharged from the liquid discharge head to the recording medium between the first gap and the second gap, an estimated temperature such that the estimated temperature is increased in accordance with the increase of the temperature rise amount, the estimated temperature is an estimated temperature of the liquid discharge head before the nozzle surface faces the first gap; and determining the waveform based on the estimated temperature, while the nozzle surface is facing the first gap.

* * * * *